US007022166B2

(12) United States Patent
Gittler

(10) Patent No.: US 7,022,166 B2
(45) Date of Patent: Apr. 4, 2006

(54) ELECTROSTATIC DUST SEPARATOR

(75) Inventor: Philipp Gittler, Leonding (AT)

(73) Assignee: Voest - Alpine Industrieanlagenbau GmbH & Co., (AT)

( * ) Notice: Subject to any disclaimer, the term of this patent is extended or adjusted under 35 U.S.C. 154(b) by 6 days.

(21) Appl. No.: 10/297,572

(22) PCT Filed: May 25, 2001

(86) PCT No.: PCT/EP01/06020

§ 371 (c)(1),
(2), (4) Date: Apr. 25, 2003

(87) PCT Pub. No.: WO01/94023

PCT Pub. Date: Dec. 13, 2001

(65) Prior Publication Data

US 2003/0159585 A1 Aug. 28, 2003

(30) Foreign Application Priority Data

Jun. 6, 2000 (AT) ..... A 990/2000

(51) Int. Cl.
*B03C 3/36* (2006.01)

(52) U.S. Cl. ..... 96/64; 55/418

(58) Field of Classification Search ..... 96/64, 96/60; 95/78; 55/418, 487
See application file for complete search history.

(56) References Cited

U.S. PATENT DOCUMENTS

| | | | | |
|---|---|---|---|---|
| 3,425,189 | A * | 2/1969 | Haselmayer | 96/64 |
| 3,733,785 | A * | 5/1973 | Gallaer | 96/64 |
| 3,990,871 | A * | 11/1976 | Cooper | 96/64 |
| 4,207,083 | A * | 6/1980 | Gelhaar et al. | 96/64 |
| 4,544,383 | A * | 10/1985 | Haselmaker | 96/64 |
| 4,581,045 | A * | 4/1986 | Jury | 96/64 |
| 5,156,658 | A * | 10/1992 | Riehl | 96/64 |
| 5,882,383 | A * | 3/1999 | Dingfelder | 96/55 |
| 6,254,668 | B1 * | 7/2001 | Huang | 96/18 |
| 2001/0039877 | A1 * | 11/2001 | Hein | 95/69 |

FOREIGN PATENT DOCUMENTS

| | | |
|---|---|---|
| DE | 520710 | 3/1931 |
| EP | 0252371 | 1/1988 |
| GB | 755757 | 8/1956 |
| GB | 1153028 | * 5/1969 |

* cited by examiner

*Primary Examiner*—Richard L. Chiesa
(74) *Attorney, Agent, or Firm*—Ostrolenk, Faber, Gerb & Soffen, LLP

(57) ABSTRACT

The invention relates to an electrostatic dust separator for horizontal gas throughflow, with a housing which is substantially rotationally symmetrical in relation to a central housing axis, with a tubular inlet port flaring in a single conical section up to 80 to 95% of the housing diameter, the remaining widening of 5 to 20% of the housing diameter taking the form of a step which is configured substantially perpendicularly and radially symmetrically in relation to the housing axis, with at least two perforated gas-distributing plates arranged in the conical section and substantially perpendicularly in relation to the housing axis.

8 Claims, 2 Drawing Sheets

ELECTROSTATIC DUST SEPARATOR

Figure 1:
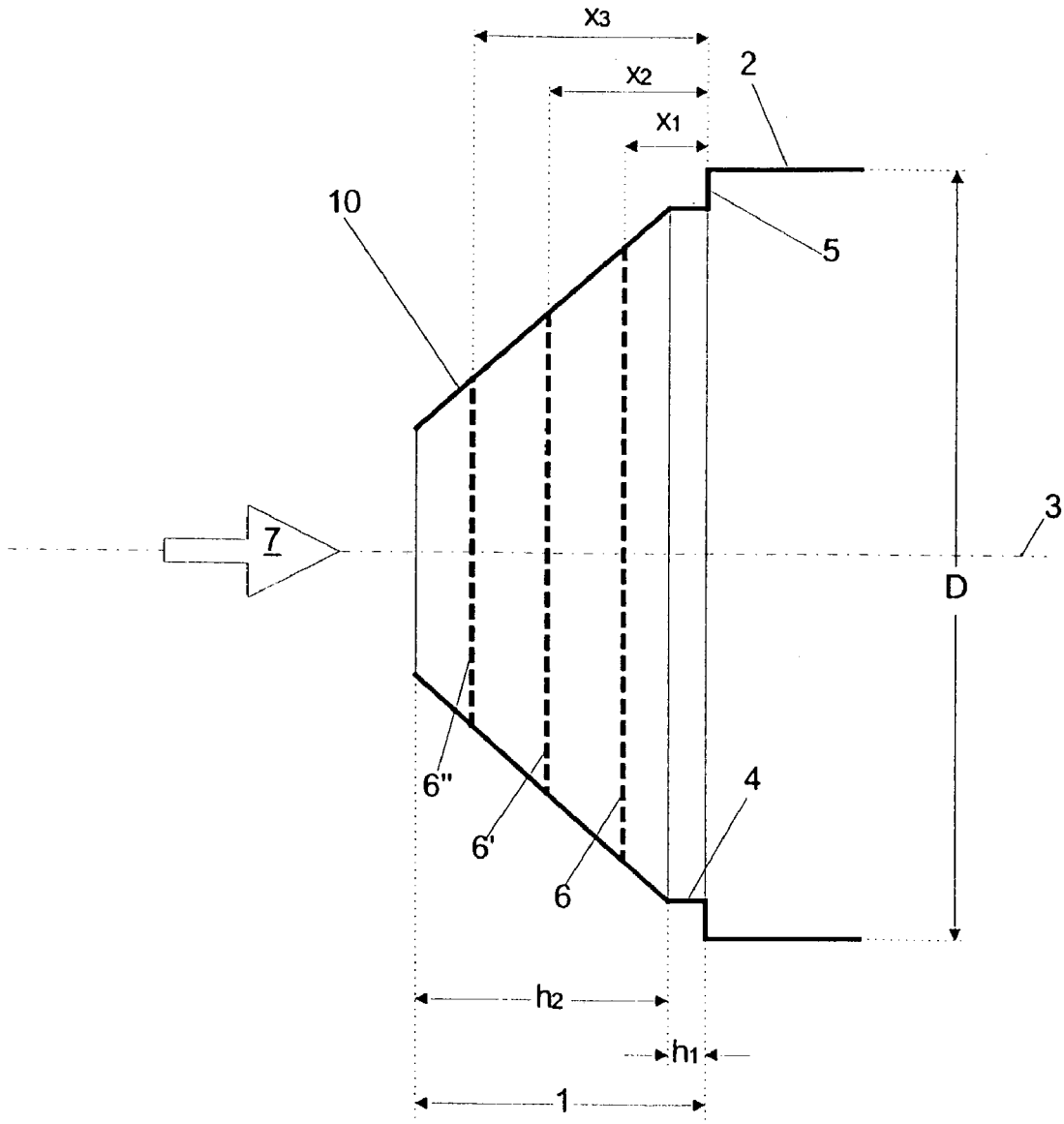

This application is a national stage of International Application No. PCT/EP01/06020, filed on May 25, 2001.

The invention relates to an electrostatic dust separator for horizontal gas throughflow, with a housing which is substantially rotationally symmetrical in relation to a central housing axis.

Such electrostatic filters are known from the prior art and usually have vertical plate-shaped precipitating electrodes, which are arranged at equidistant intervals parallel to the main axis of the housing. The precipitating electrodes are in this case arranged at equidistant intervals parallel to the main axis of the housing, which extends substantially over the entire available height corresponding to the respective length of the chord of a circle. Provided between the precipitating electrodes are spray electrodes clamped in a frame. In addition, to remove deposited dust from the inside wall of the housing, scraping devices may be provided, for example scraping devices which can be pivoted about the housing axis over the lower region of the housing wall, which is provided with dust-discharge openings.

A dust separator of this type is known from EP 0 252 371 A1. This dust separator has a tubular inlet port and outlet port, which are respectively formed by 3 different conical sections, the conical sections relating in size and height in a specific way to the housing diameter of the dust separator. In the central conical section, three perforated gasdistributing plates are arranged.

Dust separators of this type of design are used for the dry removal of dust from useful and waste industrial gases, in particular if permanently or periodically explosive gas mixtures are concerned. For example, dust is removed in this way from top gases from furnaces which operate at a positive pressure of 1.5 to 2.5 bar, to allow them to be reduced to 40 to 80 mbar without the risk of erosion for energy recovery in turbines, the dust content having to be reduced in advance to 5 to 20 mg/m$^3$. With a view to a usable pressure gradient that is as high as possible, only electrostatic filters with a pressure loss of 1 to 2 mbar come into consideration for this, since high-performance scrubbers of an equivalent separating performance have a pressure loss of 200 to 400 mbar.

A further application area for dust separators of this type is that of coal grinding plants, the waste gases of which are explosive within certain limits because of the coal dust content. Uncontrolled changes in the gas composition caused by coal dust deposits being swirled up or by the infiltration of secondary air must in any event be avoided here.

The removal of dust from waste gases of steel converters is also particularly critical, because the dust separator is alternately subjected to the throughflow of combustible gases and ambient air mixed only with small amounts of dust and gases, owing to the discontinuous mode of operation. The combustible gases are collected in containers or fed into gas supply systems following the dust removal, while the gases occurring intermittently outside the actual blowing phases of the converter are discharged into the atmosphere via a flue after dust removal. Serving for this purpose is a switching device downstream of the dust separator, which is controlled on a time basis or in dependence on the gas composition. Pressure surges in the gas flow may be initiated by the switching device, by the converter and also by instances of deflagration upstream of the dust separator and then cause dust accumulations in the dust separator, or in the upstream system of ducts, to be detached and swirled in the gas flow. Such "dust surges" on the one hand impair the separating performance of the dust separator and on the other hand involve an increased risk of deflagration.

On account of the current ever more stringent environmental legislation, however, it is no longer sufficient to use dust separators in which merely the risk of dust surges and instances of deflagration is minimized. With relevant electrostatic filters known from the prior art, in particular from EP 0 252 371 A1, it is scarcely possible any longer to satisfy the current legal regulations with respect to the dust content of the clean gas. A further disadvantage of the electrostatic filter known from EP 0 252 371 A1 is that the three conical sections of the tubular inlet and outlet ports are technically difficult to realize and require high expenditure.

It is therefore the object of the present invention to propose an electrostatic dust separator which has a separating efficiency that is improved in comparison with the prior art and which can be produced at lower cost, although the low tendency toward deflagration known from the prior art is to be maintained.

This object is now achieved according to the invention by the combination of the following features: that the electrostatic dust separator is provided with a tubular inlet port flaring in a single conical section up to 80 to 95% of the housing diameter, the remaining widening of 5 to 20% of the housing diameter taking the form of a step which is configured substantially perpendicularly and radially symmetrically in relation to the housing axis, with at least two perforated gas-distributing plates arranged in the conical section and substantially perpendicularly in relation to the housing axis.

This combination of features surprisingly succeeds in retaining the tendency not to undergo deflagration but in increasing the separating efficiency in comparison with the dust separator known from the prior art. The increase in separating efficiency is in this case based on a gas velocity profile that is largely made more even over the cross section of the dust separator, as a result of which the dwell time distribution is likewise made more even.

While these factors influence the running operation of the electrostatic filter, more simple and less costly production is possible on account of the simple construction of the dust separator according to the invention, with only a single cone and a step. It is also possible, furthermore, to convert existing dust separators quickly and not very cost-intensively into dust separators according to the invention.

According to an advantageous embodiment, which contributes to the further optimization of the gas velocity distribution, a cylindrical section is provided between the conical section and the step-shaped widening, the height ($h_1$) of the cylindrical section being 5 to 15%, preferably approximately 10%, of the housing diameter D.

To ensure an optimum gas distribution, it is expedient for the height $h_2$ of the conical section to be in a specific size ratio in relation to the housing diameter. A height $h_2$ of the conical section of 20 to 40% of the housing diameter has proven to be particularly advantageous here.

It has also proven to be advantageous if at least three, preferably precisely three, perforated gas-distributing plates are provided in the conical section of the tubular inlet port, the gas permeability of the perforated gas-distributing plates increasing/decreasing in the direction of gas flow from 51–47% to 48–44% and then to 45–41%.

In addition, the positions $x_1$ to $x_3$ of the perforated gas-distributing plates obey the following relationship, $x_1$ to $x_3$ being measured along the housing axis, to be precise from the cross-sectional plane of the step-shaped setback, that is from the step/cone transition or step/cylindrical-section transition, counter to the direction of gas flow:

$$x_{1,2,3}=\xi_{1,2,3}\times h_2+h_1$$

where $\xi_1$=0.18 to 0.28

$\xi_2$=0.45 to 0.60

$\xi_3$=0.76 to 0.92.

According to a further advantageous embodiment, there follows on the gas outlet side of the housing a step-shaped narrowing to 80 to 95% of the housing diameter, which narrowing is configured substantially perpendicularly and radially symmetrically in relation to the housing axis.

It is also expedient if the step-shaped narrowing is followed by a section tapering conically in a single section, with at least one perforated gas-distributing plate arranged in the conical section and substantially perpendicularly in relation to the housing axis, and the height ($h_4$) of the conical section being 20 to 40% of the housing diameter D.

The conical section and step-shaped narrowing in this case together form a tubular outlet port of the dust separator according to the invention.

In this case, a cylindrical section is advantageously arranged between the step-shaped narrowing and the tubular outlet port, the height ($h_3$) of the cylindrical section being 5 to 15% of the housing diameter D.

In a preferred way, three perforated gas-distributing plates are provided in the conical section of the tubular outlet port, the gas permeability of the perforated gas-distributing plates increasing/decreasing in the direction of gas flow from 41–45% to 44–48% and then to 47–51%.

In a preferred embodiment of the dust separator according to the invention, the tubular inlet and outlet ports are of the same, but mirror-invertedly symmetrical, configuration.

Particularly preferred here for the tubular inlet and outlet ports are in each case the cylindrical section arranged between the conical section and the step-shaped widening and in each case three perforated gas-distributing plates arranged in the respective conical part.

The fact in itself of configuring the tubular inlet and outlet ports in a similar and mirror-inverted form is admittedly known from the prior art, but the combination according to the invention of the cone, step-shaped widening and perforated gas-distributing plates is not.

Whereas until now the separating performance of an electrostatic filter has decreased sharply on the last section of path before the tubular outlet port, the configuration of the tubular outlet port according to the invention succeeds in making the gas velocity distribution more even over the cross section in this region as well, and consequently succeeds in achieving a constant separating performance over the entire length of the dust separator.

Figure 2:
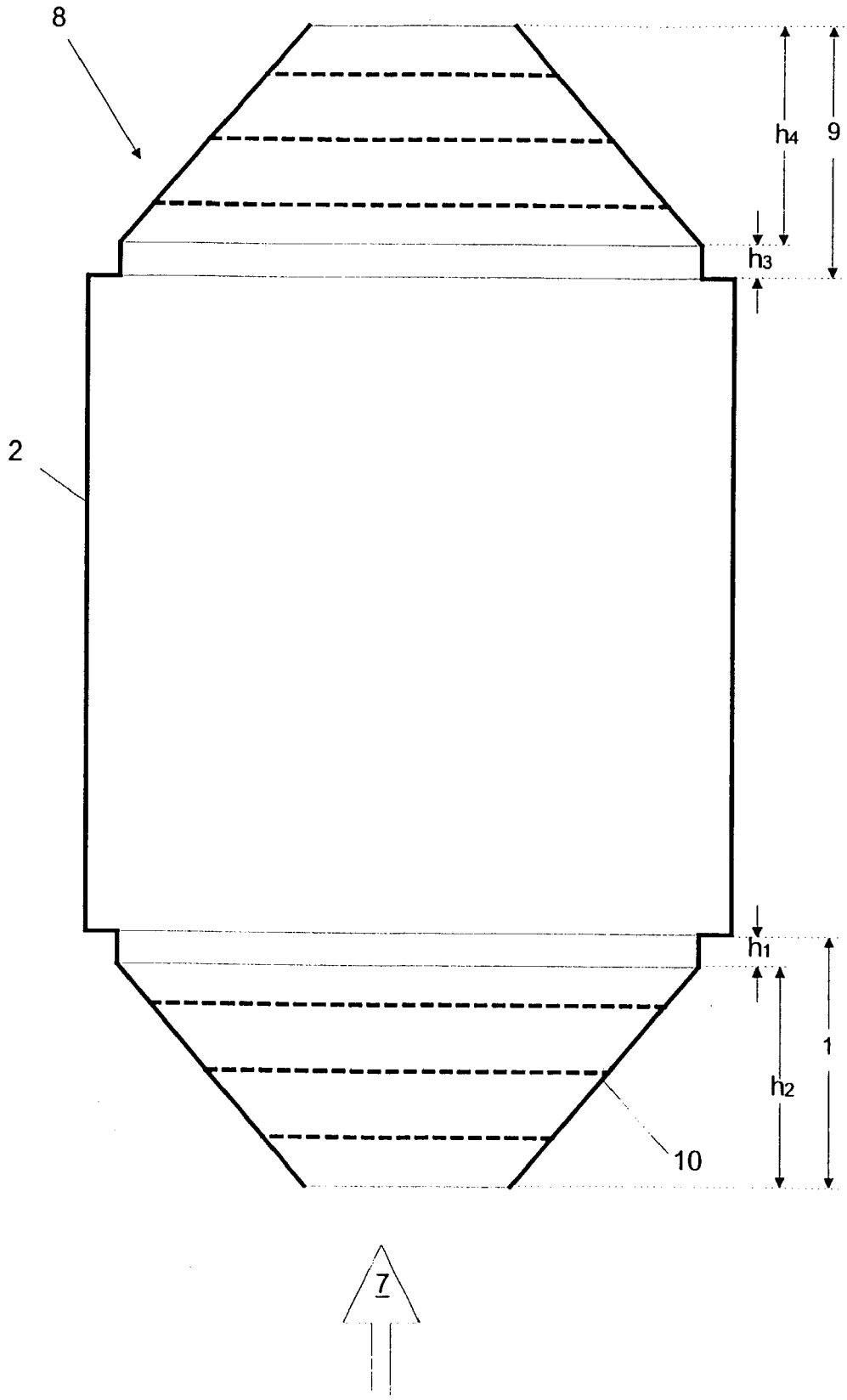

The dust separator according to the invention is explained in more detail below on the basis of the exemplary embodiments represented in FIGS. 1 and 2 of the drawings, in which FIG. 1 shows the tubular inlet port with perforated gas-distributing plates, FIG. 2 shows the dust separator according to the invention.

Schematically represented in FIG. 1 is a tubular inlet port 1 for a dust separator according to the invention, with a substantially cylindrical housing 2 and a central housing axis 3. The tubular inlet port 1 flares in a single conical section 10 to approximately 90% of the diameter D of the housing 2 of the dust separator and the height $h_2$ of the conical section 10 is approximately 35% of the housing diameter D. The conical section 10 is followed by a cylindrical section 4, the height $h_1$, of which is approximately 5% of the housing diameter D. The remaining 10% of the widening in diameter to the housing diameter D takes the form of a step-shaped, radially symmetrical setback 5. In the conical section 10, perforated gas-distributing plates 6, 6', 6" are arranged at the intervals $x_1$ to $x_3$, the intervals $x_1$ to $x_3$ being measured from the plane of the step-shaped setback 5. The direction of gas flow is indicated by the arrow 7.

Schematically represented in FIG. 2 is a dust separator 8 according to the invention, with a tubular inlet port 1, a housing 2 and a tubular outlet port 9, the arrow 7 again illustrating the direction of gas flow.

The internal fittings present in the housing 2, such as precipitating and spray electrodes, scraping devices etc., are not shown in the drawing—because they are not essential for the invention.

The tubular inlet port 1 and the tubular outlet port 9 are identically constructed in FIG. 2, so that $h_1=h_3$ and $h_2=h_4$. Furthermore, the respective dimensions $x_1$ to $x_3$ of the tubular inlet and outlet ports are also of the same size.

The invention claimed is:

1. An electrostatic dust separator for horizontal gas throughflow comprising:

a housing which is substantially rotationally symmetrical in relation to a central housing axis;

a tubular inlet port flaring in a single conical section up to 80 to 95% of the housing diameter, the remaining widening of 5 to 20% of the housing diameter taking the form of a step which is configured substantially perpendicularly and radially symmetrically in relation to the housing axis;

a cylindrical section between the conical section and the step-shaped widening; and at least two perforated gas-distributing plates arranged in the conical section and substantially perpendicularly in relation to the housing axis.

2. An electrostatic dust separator according to claim 1, wherein the height ($h_1$) of the cylindrical section is 5 to 15% of the housing diameter D.

3. An electrostatic dust separator according to claim 1, wherein the height ($h_2$) of the conical section is 20 to 40% of the housing diameter.

4. An electrostatic dust separator according to claim 1, wherein at least three perforated gas-distributing plates are provided in the conical section.

5. An electrostatic dust separator according to claim 1, wherein three perforated gas-distributing plates are provided in the conical section of the tubular inlet port, the gas permeabilty of the perforated gas-distributing plates increasing/decreasing in the direction of gas flow from 51–47% to 48–44% and then to 45–41%.

6. An electrostatic dust separator according to claim 1, wherein the height ($h_1$) of the cylindrical section is approximately 10% of the housing diameter D.

7. An electrostatic dust separator for horizontal gas throughflow comprising:

a housing which is substantially rotationally symmetrical in relation to a central housing axis;

a tubular inlet port flaring in a single conical section up to 80 to 95% of the housing diameter, the remaining widening of 5 to 20% of the housing diameter taking the form of a step which is configured substantially perpendicularly and radially symmetrically relation to the housing axis;

at least two perforated gas-distributing plates arranged in the conical section and substantially perpendicularly in relation to the housing axis;

a step-shaped narrowing to 80 to 95% of the housing diameter on the gas outlet side of the housing, which narrowing is configured substantially perpendicularly and radially symmetrically in relation to the housing axis a section tapering conically in a single section following the step-shaped narrowing, with at least two perforated gas-distributing plates arranged in the conical section and substantially perpendicularly in relation to the housing axis, and the height ($h_4$) of the conical section being 20 to 40% of the housing diameter D; and a cylindrical section arranged between the step-shaped narrowing and tubular outlet port, the height ($h_3$) of the cylindrical section being 5 to 15% of the housing diameter D.

8. An electrostatic dust separator according to claim 7, wherein three perforated gas-distributing plates are provided in the conical section of the tubular outlet port, the gas permeability of the perforated gas-distributing plates increasing/decreasing in the direction of gas flow from 41–45% to 44–48% and then to 47–51%.

* * * * *